US005433189A

United States Patent [19]

Bales et al.

[11] Patent Number: 5,433,189

[45] Date of Patent: Jul. 18, 1995

[54] OVEN DOOR HEAT DISSIPATION SYSTEM

[75] Inventors: Michael E. Bales, New Palestine; Gregory A. Martin; Douglas D. Swank, both of Indianapolis, all of Ind.

[73] Assignee: Maytag Corporation, Newton, Iowa

[21] Appl. No.: 198,113

[22] Filed: Feb. 17, 1994

[51] Int. Cl.[6] ..... F24C 15/04

[52] U.S. Cl. ..... 126/198; 126/190; 126/200

[58] Field of Search ..... 126/198, 190, 200; 432/194, 237, 238, 250

[56] References Cited

U.S. PATENT DOCUMENTS

| | | | |
|---|---|---|---|
| 3,855,994 | 12/1974 | Evans et al. | 126/198 |
| 3,939,817 | 2/1976 | Nuss | 126/190 |
| 4,125,354 | 11/1978 | Andrews | 431/11 |
| 4,253,286 | 3/1981 | Katona | 126/198 X |
| 4,383,519 | 5/1983 | Katona | 126/190 |
| 4,520,791 | 6/1985 | Chamberlain | 126/198 X |

*Primary Examiner*—Larry Jones

*Attorney, Agent, or Firm*—Willian Brinks Hofer Gilson & Lione

[57] ABSTRACT

An oven door having a localized interior surface area exposed to high oven temperature and susceptible to the generation of excessive temperature at an adjacent outside surface area, is provided with a heat collector plate fastened over the localize interior surface area with fastening means in heat transfer relationship with said heat collecting plate and with a heat dissipator attached outside of the oven door remotely from said adjacent outside surface area, for dissipating heat to ambient atmosphere.

15 Claims, 3 Drawing Sheets

OVEN DOOR HEAT DISSIPATION SYSTEM

FIELD OF THE INVENTION

The present invention relates to oven doors and particularly to oven doors having a localized interior surface susceptible to excessive temperature raises. More particularly, the invention relates to such oven doors having transparent viewing panels for inspecting the contents of an oven that limit convective cooling of adjacent interior surface areas.

BACKGROUND

Oven doors are constructed to retain heat inside an oven cavity. Typically, oven doors are made using inner and outer door panels positioned in a parallel, spaced-apart relationship and joined together at the edges to form therebetween an interior region. The inner panel, facing the interior of the oven, absorbs large amounts of heat, which is transferred to the outer panel by conduction, radiation, and convection. It is desirable to limit the temperature rise of the outside surface of the door and to avoid hot spots of excessive temperature. Underwriters' Laboratories, Inc. has specified a limit of 152° F. for the acceptable temperature for a stainless steel outer door panel. Maintaining the entire outside surface of an oven door at 152° F. or less is frequently difficult. In self-cleaning ovens the temperature within the oven can reach 950° F. during the cleaning process. At that temperature, much heat is transferred through the inner panel to the outer panel, and the outer door surface can be heated beyond an acceptable temperature without means for reducing the temperature of outside surface of the door.

One method known in the art for reducing the surface temperature of the outer panel is the use of convective heat transfer. In using convective heat transfer, apertures are formed in the top and bottom of the outer panel of the door. Warm air from the interior region between the inner and outer panels of the door rises through the apertures formed in the top of the outer door panel and draws cooling air from outside of the oven up into the interior region through the apertures in the bottom of the door. As the cooling air travels through the interior region, it picks up heat from the outer door panel and carries it away to the atmosphere, thereby cooling the outer door panel.

It is desirable to be able to observe, from time to time, the interior of the oven. To permit visual inspection without the necessity of opening the oven door and thereby losing heat to the atmosphere, it is known to install glass panels in the oven door. See, for example, U.S. Pat. No. 3,939,817 to Nuss. Nuss discloses an oven door having a glass viewing window in the outer panel and cooling air channels which allow room air to pass up through the door.

Underwriters' Laboratories, Inc. has specified a 172° F. limit for the acceptable surface temperature for glass, which is the preferred material for use as a viewing window. To meet the 172° F. limit, thermally insulating viewing window assemblies have been developed. Such assemblies include multiple glass panes separated by insulative air gaps and sealed into a unit. Unfortunately, when installed in the door, the window elements can block the flow of cooling air through the door and cause localized areas of increased temperature, ("hot spots") in the outer panel, particularly in the area of the outer panel above the viewing window assembly. It has long been a desire that oven doors be provided with means for eliminating localized areas of excessive temperature and, particularly for eliminating "hot spots" caused by insulative viewing windows of oven doors.

SUMMARY OF THE INVENTION

In the invention an oven door having a localized interior area susceptible to the generation of excessive surface temperatures at an adjacent outside surface is provided with means for collection and transfer of heat from the localized interior "hot spot" to the ambient environment outside of the oven door. In an oven door of the invention, a heat collector is provided over the localized interior "hot spot" with means that transfer heat collected by the heat collector from the heat collector to a separate heat dissipator.

In preferred embodiments of the invention, the heat collector can be a thermally conductive plate fastened over the localized interior area that is susceptible to the generation of excessive temperatures by fastening means that transfer heat from the thermally conductive heat collector plate to a heat dissipation surface or heat sink outside of the oven door, which can be, in preferred embodiments of the invention, handle means for the oven door.

Specifically, an oven door of the invention can include an outer door panel having an inner and outer surface and an inner door panel. The inner door panel can be coupled to the outer door panel and cooperate with the outer door panel to define an interior region between the inner and outer panels. A transparent window means for visual inspection of the oven interior can be located centrally in the oven door and extend into the interior region between the inner and outer panels. A plurality of heat-transfer apertures can be formed in the outer door panel to provide convective heat transfer for removing heat from the interior region between the panels. The heat collector plate can be attached to the inner surface of the outer door panel at a location over the window means susceptible to the generation of excessive temperatures because of the interference of the window means with convective heat transfer from the area above the window means.

The outer door panel can include a plurality of apertures, and the heat collector plate can be attached through the plurality of apertures by heat transferring fasteners to bracket means for attaching the door handle and to the door handle on the outer surface. Thus, the heat collector plate, heat transferring fasteners, handle brackets, and door handle define a path for heat transfer from a localized interior hot spot to the outside environment.

Additional objects, features, and advantages of the invention will become apparent to those skilled in the art upon consideration of the drawings and the following detailed description of a preferred embodiment exemplifying the best mode of carrying out the invention as presently perceived.

BRIEF DESCRIPTION OF THE DRAWINGS

FIG. 1 is a diagrammatic side cross sectional view of an oven door of the present invention taken at the plane corresponding to line 1—1 of FIG. 2; and FIG. 2 is a diagrammatic top cross sectional view of an oven door of the invention taken at line 2—2 of FIG. 1;

DETAILED DESCRIPTION OF THE DRAWINGS

Figure 2:
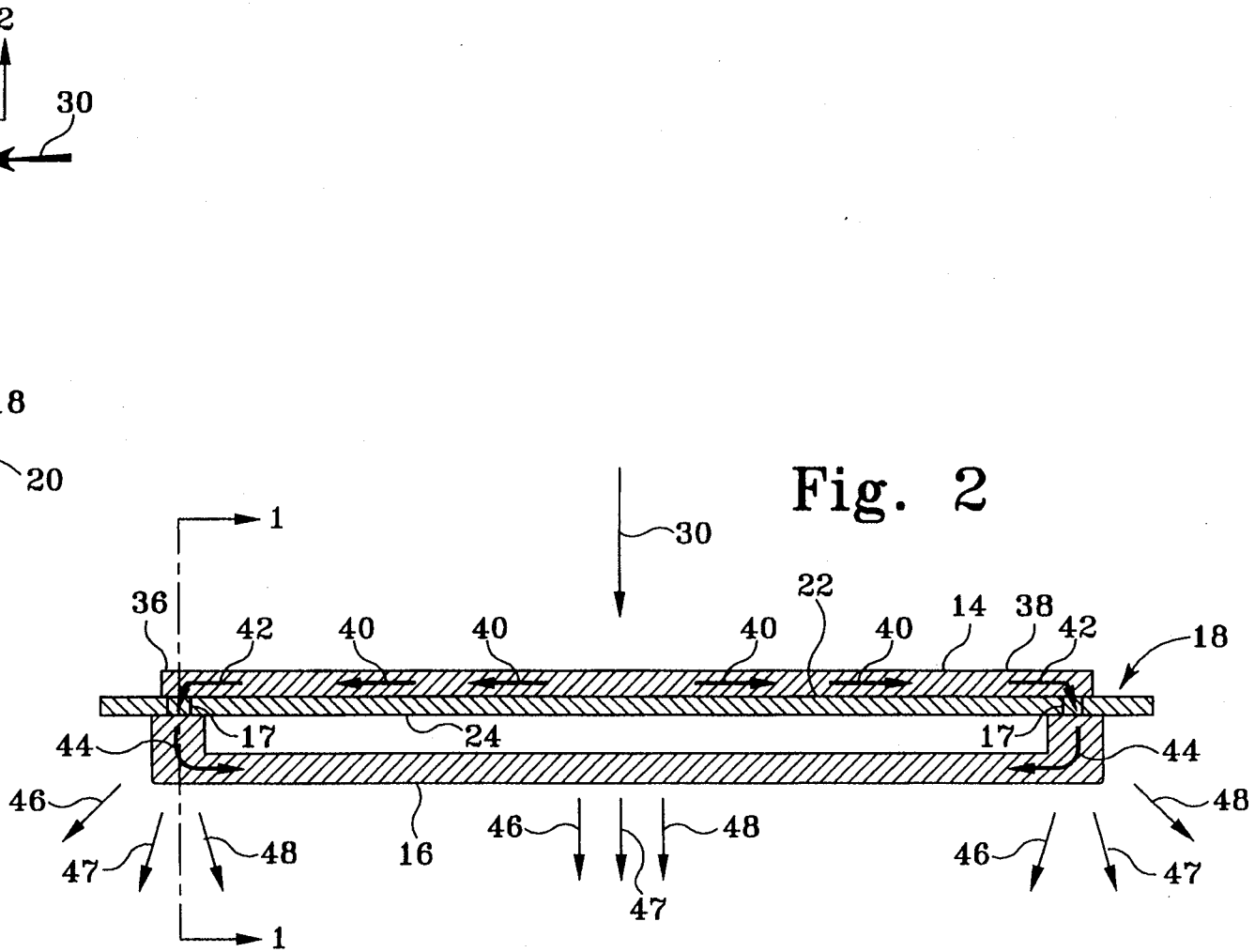
FIGS. 1 and 2 are simple diagrams of an oven door of the invention to help explain its operation.
Figure 1:
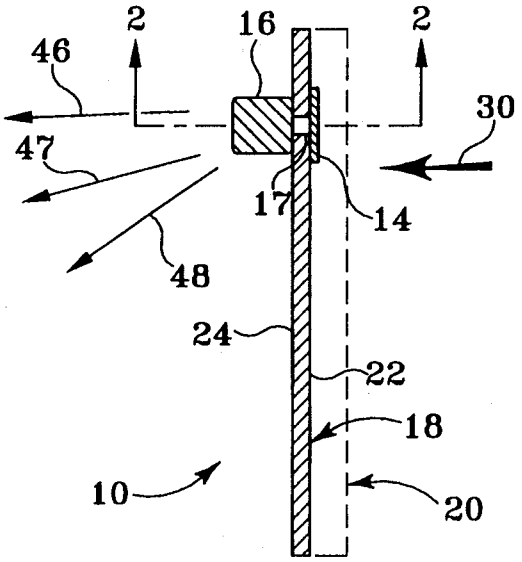
Figure 4:
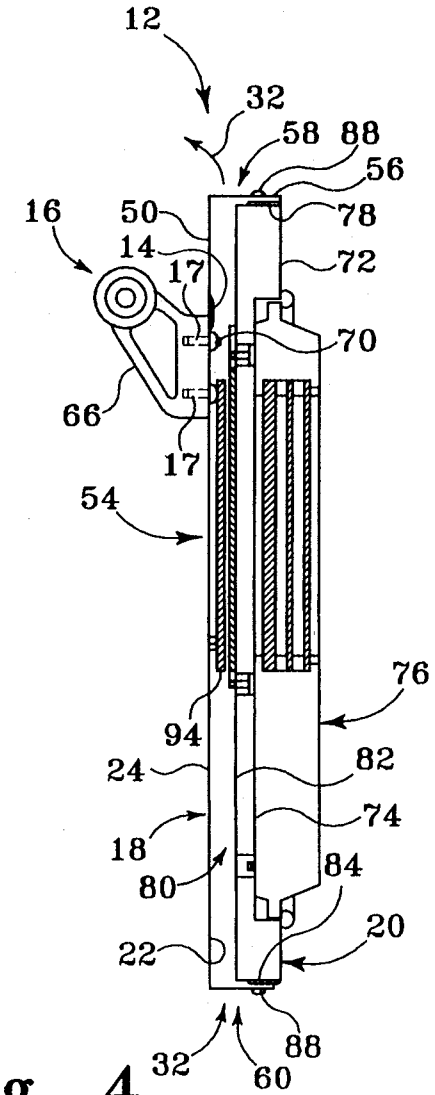
FIG. 4 is a side view of the oven door of FIG. 3.
Figure 3:
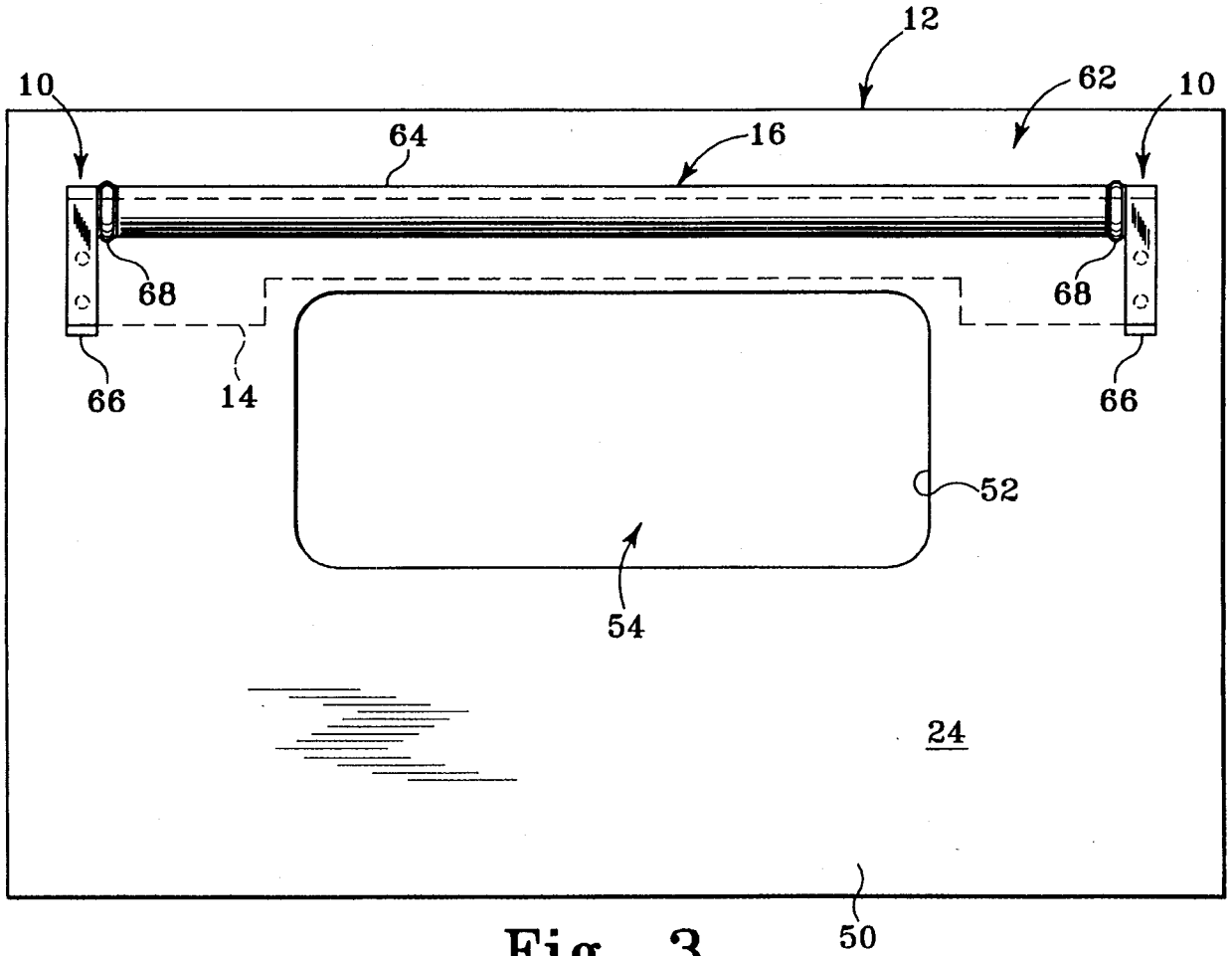
FIG. 3 is a front view of an oven door incorporating one embodiment of the invention.

An oven door 12 of the present invention is illustrated generally in FIGS. 1–2. The oven door 12 includes a heat collecting and transferring means 10 for preventing the generation of a localized excessive temperature as described more fully below. Typically, an oven door 12 will include at least an outer panel 18 and an inner panel 20, as shown in FIGS. 3–4. However, for purposes of clarity, only the outer panel 18 is depicted in FIGS. 1–2. (The general location of an inner panel 20 is indicated in phantom line in FIG. 1.)

Referring to FIGS. 1–2, the outer panel 18 has an inner surface 22 facing an oven cavity and an outer surface 24 facing the outside environment. The outer panel 18 may be susceptible to the generation of excessive temperature at the localized area occupied by element 14 due to heat, indicated generally by arrow 30, to which it is exposed. The arrow 30 is only to illustrate heat generally, as it must be understood, that heat may be transferred to and from the outer panel 18 by radiation, conduction and convection.

In accordance with the invention, a heat collector 14 is attached to the inner surface 22 of the outer panel 18. The heat collector 14 abuts the inner surface 22 generally in the area susceptible to the generation of excessive temperatures to prevent the adjacent outer surface 24 of the oven door 12 from developing an adjacent area which is unacceptably hot. The heat collecting and transferring means 10 further includes means for transferring heat collected by heat collector 14 to the ambient environment outside of the oven door 12. As a result of their heat transfer relationship, heat from heat collector 14 is transferred through the outer panel 18 by heat transfer means 17 and to a heat dissipator, or heat sink 16. In order to provide an effective heat transfer path, the heat collector 14, the heat sink or heat dissipator 16, and the heat transfer means 17 are made from materials, such as aluminum, having excellent thermal conductivity properties.

As shown in FIGS. 1–2, in oven doors of the invention, heat 30 flows into the heat collector 14. The heat 30 may be in the form of radiant, conducted and/or convected heat. As the heat is absorbed by the heat collector 14, a temperature gradient results between the warmer heat collector 14 and the cooler heat sink/dissipator 16 and heat transfer means 17. Since heat travels along a temperature gradient from warmer areas to cooler areas, the heat in the heat collector 14 moves toward the heat transfer means 17 at ends 36, 38 of the heat collector 14 and through the heat transferring means 17 into the heat sink 16, as illustrated by arrows 40, 42, 44, respectively. Another temperature gradient exists between the warmer heat sink/dissipator 16 and the cooler ambient atmosphere, and the heat in the heat sink 16 is dissipated to the atmosphere, primarily by radiant and convected heat transfer, represented by arrows 46, 47, and 48. Thus, in effect, the atmosphere functionally becomes part of the heat sink 16. Because of the collection and transfer of heat by the heat collecting and transferring means 10 (i.e., heat collector 14, heat transfer means 17 and heat sink/dissipator 16), the temperature of the outer door panel 18, and the outer surface 24 thereof, adjacent heat collector 14 can be maintained at acceptable temperatures.

FIGS. 3 and 4 illustrate the invention in an illustrative oven door 12. Such an oven door, as shown in FIGS. 3–4, includes an outer panel 18 and an inner panel 20. The outer panel 18 includes a rectangular flat panel portion 50 having an aperture 52 for receiving an outer viewing window 54. A perimetric skirt 56 extends orthogonally from the flat panel member 50 and includes a top portion 58 and a bottom portion 60 (the side portions are not shown). The top and bottom portions 58, 60 include a plurality of apertures (not shown) for allowing cooling air 32 to flow through the interior region 80.

The inner panel 20 includes a rectangular flat panel member 72 having an indentation 74 for receiving an insulative viewing window assembly 76 and a perimetric skirt 78 extending orthogonally from the flat panel member 72. The insulative viewing window assembly 76 can be of conventional design having multiple glass panels positioned in parallel spaced apart relation and sealed into a unit. The flat panel member 72 is sized to position the inner panel perimetric skirt 78 adjacent the outer panel perimetric skirt 56 and thereby form an interior region 80.

In preferred embodiments, the door 12 also includes an intermediate panel 82 positioned in the interior region 80. The intermediate panel 82 includes a rectangular flat panel member 84 having a perimetric skirt 86 extending orthogonally therefrom. The outer, inner, and intermediate panels 18, 20, 82 are aligned with each other in parallel spaced apart relation with their respective perimetric skirts 56, 78, 86 positioned next to each other. The outer, inner, and intermediate panels 18, 20, 82 are fastened together by screws 88 extending through the perimetric skirts, with the outer and intermediate panels 18, 82 being separated from each other to form a channel for the flow 32 of cooling air for convective heat transfer.

The insulative viewing window assembly 76 is positioned in the indentation 74 of the inner panel 20 and attached to the inner panel 20. The outer viewing window 54 is aligned with the aperture 52 in the outer panel 18 and with the outer glass panels in the insulative viewing window assembly 76 to provide for visual inspection of the contents of the oven cavity. Window packing 90 is positioned around the aperture 52 and the outer viewing window 54 is positioned against the window packing 90. The outer viewing window 54 is held in contact with the window packing (not shown) by a glass retainer 94.

In such oven doors, the installed window elements may so obstruct the flow 32 of cooling air through the interior region 80 that the area of the outer panel 18 above the aperture 52 for the window may not receive sufficient convective cooling and may be susceptible to the generation of unacceptable temperatures at its adjacent outside surface. Accordingly, a heat collecting and transferring system 10 is attached to the outer panel 18.

Figure 5:
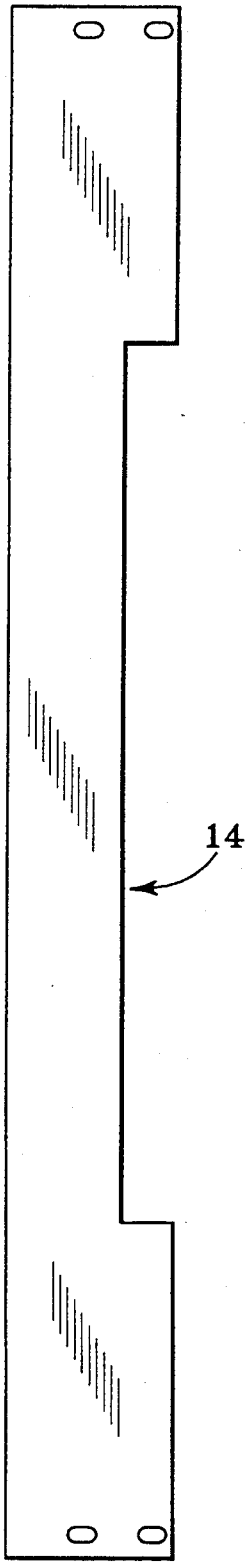
FIG. 5 is a plan view of one embodiment of a heat collector plate used in the invention.
Figure 6:
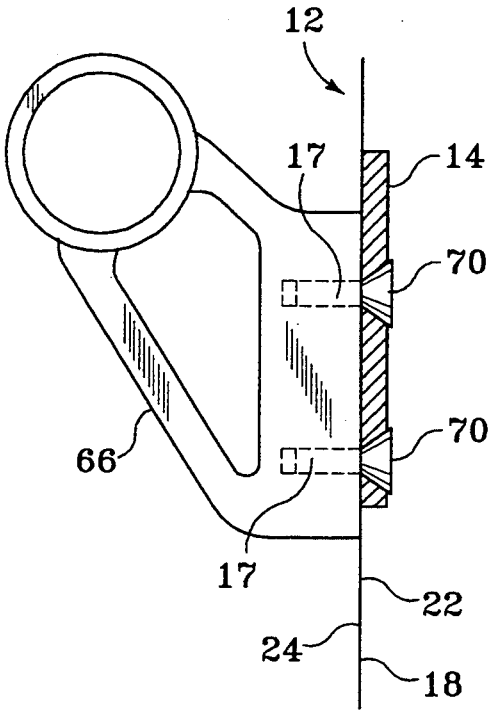
FIG. 6 is a side view of the heat dissipation system illustrating the heat collecting, transferring and dissipating means of the oven door of FIGS. 3 and 4.

A heat collector 14, preferably a plate as shown in plan form in FIG. 5, is positioned against the inner surface 22 of the outer panel 18 in the area above the window aperture 52, as shown in phantom lines in FIG. 3. As seen in FIGS. 3 and 6, the heat collector 14 (in phantom in FIG. 3) is adjacent a handle 62, which in the oven door of FIGS. 3 and 4 serves as the heat sink/dissipator 16. The handle 62 includes a tubular member 64, a bracket 66, and a coupler 68 at each end of the tubular member 64 for coupling the tubular member 64 to the bracket 66. The handle 62 and the heat collector 14 are attached to the outer panel 18 and to each other by pan screws 70. In preferred embodiments of FIGS. 3 and 4, the pan screws 70 serve a dual purpose. In addition to attaching the handle 62 to the heat collector 14, the pan screws 70 also serve as heat transferring means 17 for transferring heat from the collector 14 through outer panel 18 to the handle 62, which dissipates the heat to ambient atmosphere. It will be understood that other suitable attachment means, such as bolts, rivets or even thermally conductive adhesive can be used in place of pan screws 70. Thus, in the oven door of FIGS. 3 and 4, the area of the outer panel 18 adjacent the heat collector plate 14 is maintained at acceptably lower temperatures by the transfer and dissipation of heat from the area above the window aperture 52 to the ambient environment outside of the oven door.

Although the invention has been described in detail with reference to a certain preferred embodiment, variations and modifications may exist within the scope and spirit of the invention as described and defined in the following claims.

We claim:

1. A system for use with an oven door having an outer door panel, an inner door panel coupled to the outer door panel and cooperating with the outer door panel to define an interior region, and a transparent window for allowing visual inspection within an oven, the outer door panel having an inner surface and an outer surface, the system comprising:

a localized heat collector attached adjacent the inner surface of the outer panel for collecting heat in the interior region, a heat dissipator coupled to the outer surface for dissipating heat to the surrounding environment, and heat transfer means for transferring heat from the heat collector to the heat dissipator.

2. The system of claim 1, wherein the outer door panel includes a plurality of apertures and the heat collector is attached to the heat dissipator through the plurality of apertures by the heat transfer means.

3. The system of claim 2, wherein the heat collector includes a thermally conductive plate and the heat dissipator includes a door handle for opening the oven door and bracket means for attaching the door handle means to the outer door panel, and the heat transfer means includes a plurality of fasteners, the thermally conductive plate, the fasteners, the bracket means, and the door handle defining a path for heat transfer from the interior region to ambient atmosphere.

4. In an oven door having an outer door panel with an inner and an outer surface, an inner door panel coupled to the outer door panel and cooperating with the outer door panel to define an interior region, said outer door panel including openings for convection cooling air flow through the interior region, and transparent window means centrally located in the oven door and partially obstructing a localized area of the interior region from the convective cooling air flow, the improvement comprising, heat sink means coupled to the outer surface of the outer door panel, heat collector means attached to the inner surface of the outer door panel in the localized area of the interior region partially obstructed from convective cooling air flow, and means for transferring the heat from the heat collector means to the heat sink means.

5. The system of claim 4, wherein the heat collector means includes a thermally conductive plate and the heat sink means includes door handle means for opening the oven door and bracket means for attaching the door handle means to the outer surface, and the heat transferring means includes a plurality of fasteners, the fasteners extending through the heat conductive plate, the outer panel, and into the bracket means to physically and thermally couple the heat conductive plate and the heat sink handle means to each other.

6. An oven door for use with an oven, the door comprising:

an outer door panel having a central inspection aperture and convective heat transfer means, an inner door panel coupled to the outer door panel to form an interior region, transparent means for visual inspection of the contents of the oven, the transparent means being positioned in the inspection aperture and significantly obstructing convective cooling of the outer door panel, heat dissipation means attached to the outer door panel outside the interior region, conductive heat collection and transfer means positioned in the interior region and abutting the outer door panel adjacent the transparent means and connected with the heat dissipation means for transferring heat from inside of the outer door panel to the heat dissipation means.

7. The door of claim 6, further comprising attaching means for coupling the conductive heat collection and transfer means to the heat dissipation means, the attaching means providing a thermal pathway for the heat transferred from the conductive heat collection and transfer means to the heat dissipation means.

8. The door of claim 7, wherein the heat dissipation means includes a door handle attached to the outer door panel outside the interior region and the thermally conductive plate is attached to the door handle by heat transferring fasteners through apertures in the outer panel.

9. A door for use with an oven, the door comprising:

an outer panel having a local area susceptible to generation of an unacceptable temperature, and means for transferring heat from the local area of the outer panel to the environment outside the oven, including means inside of the outer panel adjacent the local area, for collecting and transferring heat from the local area of the outer panel, and means, outside of the outer panel, for dissipating heat to the atmosphere, said heat collecting and transferring means being in heat transfer relationship with said heat dissipating means.

10. The door of claim 9, wherein the heat collecting and transferring means includes a thermally conductive plate attached inside of the outer panel.

11. The door of claim 10, wherein the heat dissipating means includes a door handle attached to the outer panel.

12. In an oven door having a localized interior surface area exposed to high oven temperature and susceptible to excessive temperature at an adjacent outside surface area, the improvement comprising a heat collector plate fastened over the localized interior surface area with fastening means in heat transfer relationship with said heat collecting plate and with means, attached outside of the oven door remotely from said adjacent outside surface area, for dissipating heat to ambient atmosphere.

13. The invention of claim 12 wherein said heat dissipating means comprises handle means.

14. The invention of claim 12 wherein said oven door includes a window centrally located between the top and the sides of the oven door, said localized interior surface area is between the window and the top of the oven door, and said heat collector plate extends from end to end over said window between the door sides, said fastening means include threaded fasteners extending through the oven door and the ends of the heat collector plate and into threaded handle brackets.

15. The invention of claim 13 wherein said handle means includes an elongated bar extending between handle brackets across the outside surface of the door and is connected with the handle brackets by means with good thermal conductivity.

* * * * *